US010018125B2

(12) United States Patent
Sha

(10) Patent No.: US 10,018,125 B2
(45) Date of Patent: Jul. 10, 2018

(54) DIGITAL INTERNAL COMBUSTION ENGINE AND METHOD OF CONTROL

(71) Applicant: Cher Sha, West Bloomfield, MI (US)

(72) Inventor: Cher Sha, West Bloomfield, MI (US)

( * ) Notice: Subject to any disclaimer, the term of this patent is extended or adjusted under 35 U.S.C. 154(b) by 223 days.

(21) Appl. No.: 14/846,085

(22) Filed: Sep. 4, 2015

(65) Prior Publication Data

US 2017/0067400 A1 Mar. 9, 2017

(51) Int. Cl.
*F02D 17/02* (2006.01)
*F02D 41/00* (2006.01)
*F02B 53/02* (2006.01)

(52) U.S. Cl.
CPC ..... *F02D 17/02* (2013.01); *F02D 41/0087* (2013.01); *F02B 53/02* (2013.01); *F02D 41/0082* (2013.01); *F02D 2200/501* (2013.01)

(58) Field of Classification Search
CPC ..... F02D 41/0082; F02D 41/0085; F02D 41/0087
USPC ..... 123/481, 200–249
See application file for complete search history.

(56) References Cited

U.S. PATENT DOCUMENTS 5,826,563 A * 10/1998 Patel ..... F02D 17/02 123/198 F
6,209,526 B1 * 4/2001 Sun ..... F02B 17/00 123/295
7,216,638 B1 * 5/2007 Burk ..... F02D 41/0085 123/673
9,719,439 B2 * 8/2017 Brennan ..... F02D 41/0087
2003/0221659 A1 * 12/2003 Surnilla ..... F01N 3/0814 123/295
2005/0193721 A1 * 9/2005 Surnilla ..... F02D 41/0087 60/285
2008/0276904 A1 * 11/2008 Surnilla ..... F02D 41/0082 123/406.45
2010/0050993 A1 * 3/2010 Zhao ..... F02D 17/02 123/481
2013/0112158 A1 * 5/2013 Weinzierl ..... F02B 75/22 123/41.01
2016/0102620 A1 * 4/2016 Ervin ..... F02D 41/0087 123/345

(Continued)

OTHER PUBLICATIONS

Lenoir engin (http://en.wikipedia.org/wiki/Etienne_Lenoir).

(Continued)

*Primary Examiner* — Hieu T Vo
*Assistant Examiner* — Arnold Castro
(74) *Attorney, Agent, or Firm* — Brinks Gilson & Lione

(57) ABSTRACT

The present disclosure provides a digital internal combustion engine and a method for controlling the same capable of improving fuel efficiency of a vehicle and reducing pollutant emissions of a vehicle while maintaining the reliability and relatively low manufacturing cost of a traditional internal combustion engine. The digital internal combustion engine comprises a plurality of combustion chambers. Each combustion chamber may be configured to switch between a non-burning mode of operation and a burning mode of operation. A combustion chamber operating in the non-burning mode may receive substantially no fuel, whereas a combustion chamber operating in the burning mode may receive fuel to satisfy a constant, non-zero air to fuel ratio.

9 Claims, 6 Drawing Sheets

(56) References Cited

U.S. PATENT DOCUMENTS

2016/0115878 A1* 4/2016 VanDerWege ..... F02D 41/1466 123/333

OTHER PUBLICATIONS

John B. Heywood, Internal combustion engine fundamentals, (p. 2-3), McGraw-Hill Book Company, 1988.
Otto engine (http://en.wikipedia.org/wiki/Nicolaus_Otto).
Rudolf Diesel (http://wikicars.org/en/Rudolf_Diesel).
Hybrid electric vehicle (http://en.wikipedia.org/wiki/Hybrid_electric_vehicle).
Hybrid electric vehicle (http://en.wikipedia.org/wiki/Hybrid_car).
The Disadvantages of Owning a Hybrid Car (http://www.hybridcarfreak.com/hybrid-cars/the-disadvantages-of-owning-a-hybrid-car/).
PowerPedia:Fuel cell (http://peswiki.com/index.php/PowerPedia:Fuel_cell).
Fuel cell (http://en.wikipedia.org/wiki/Fuel_cell#cite_note-19).
Fuel cell challenges (http://www.fueleconomy.gov/feg/fcv_challenges.shtml).
Air-fuel ratio (http://en.wikipedia.org/wiki/Air_fuel_ratio).
Air-fuel ratio and SRF air-fuel curv (http://www.mummbrothers.com/SRF_Stuff/Secrets/Driveline/Air_Fuel.htm).
Components of Vehicle Emissions (http://www.pugetsoundcleancities.org/Vehicle_Emissions_Information.htm).
Emissions #1—Combustion chemistry (http://www.autoshop101.com/forms/h55.pdf).
Control Systems/Digital and Analog (http://en.wikibooks.org/wiki/Control_Systems/Digital_and_Analog).
Introduction: Digital Controller Analog and digital (http://www.explainthatstuff.com/analog-and-digital.html).
Introduction: Digital Controller Design(http://ctms.engin.umich.edu/CTMS/index.php?example=Introduction &section=ControlDigital).
Control theory (http://en.wikipedia.org/wiki/Control_theory).
Homogeneous Charge Compression Ignition Engines Research (http://faculty.kaust.edu.sa/sites/fabriziobisetti/Pages/hcci.aspx).
HCCI (Homogeneous-Charge Compression Ignition) (http://www.nissan-global.com/en/technology/overview/hcci.html).
Homogeneous Charge Compression Ignition (HCCI) Technology_A Report to the U.S. Congress Apr. 2001 (http://www-erd.llnl.gov/FuelsoftheFuture/pdf_files/hccirtc.pdf).
2012 Chevrolet Volt (http://www.fueleconomy.gov/feg/noframes/31618.shtml).
Fuel Economy of 2012 Chevrolet Cruze (http://www.fueleconomy.gov/feg/bymode1/2012_Chevrolet_Cruze.shtml).

* cited by examiner

DIGITAL INTERNAL COMBUSTION ENGINE AND METHOD OF CONTROL

FIELD

The present disclosure relates to a digital internal combustion engine and a method for controlling the same.

BACKGROUND

The statements in this section merely provide background information related to the present disclosure and may not constitute prior art.

Internal combustion engines are a popular form of energy production for automobiles and other vehicles. Generally, an internal combustion engine converts chemical power from fuel into mechanical energy to drive the vehicle. A typically four-stroke, spark ignition includes an intake stroke, compression stroke, power stroke, and exhaust stroke. The intake stroke includes drawing an air-fuel mixture into the combustion chamber. The compression stroke compresses the air-fuel mixture causing an increase in temperature and pressure within the combustion chamber. Next, the air-fuel mixture is ignited by a spark plug. The resulting explosion is the power stroke which generates the mechanical energy to drive the vehicle. The exhaust stroke expels the explosion exhaust gases from the cylinder.

The air to fuel ratio of the air-fuel mixture is a characteristic of an internal combustion engine that, in part, determines the power output and fuel economy of the engine. Specifically, the air to fuel ratio (AFR) is the mass of air per the mass of the fuel present in a combustion chamber during combustion.

Standard internal combustion engines operate all of the combustion chambers to generate a power output of the engine. To increase or decrease the power output of the engine, the air to fuel ratio of the air-fuel mixture is varied in the combustion chambers. Generally, the air to fuel ratio is varied between a lean mixture in which there is more air per mass of fuel and a rich mixture in which there is less air per mass of fuel. Lean mixtures provide less power but are fuel efficiency, while rich mixtures provide more power output but are less fuel efficient.

The internal-combustion engine offers a relatively small, lightweight source for the amount of power it produces. Additionally, internal combustion engines are generally reliable and cost effective to produce. However, the standard internal combustion engine generally has low fuel efficiency and high emission of pollutants.

Alternative engines have been developed to improve fuel efficiency and reduce pollutant emissions. For example, a hybrid engine combines a conventional internal combustion engine and an electric motor to generate power to drive a vehicle. While hybrid engine vehicles have higher fuel efficiency and lower pollutant emissions than a standard internal combustion engine, the hybrid engines generally generate less power output, are more expensive to produce and repair, and introduce new dangers in operation than the internal combustion engine.

Instead, the internal combustion engine can be improved for better fuel efficiency while also lowering emissions.

SUMMARY

The present disclosure provides a digital internal combustion engine and a method for controlling the same capable of improving fuel efficiency of a vehicle and reducing pollutant emissions of a vehicle while maintaining the reliability and relatively low manufacturing cost of a traditional internal combustion engine.

According to one form of the present disclosure, a digital internal combustion engine comprises a first combustion cell having a first plurality of combustion chambers and a second combustion cell having a second plurality of combustion chambers. Each combustion chamber of the first and second plurality of combustion chambers is configured to switch between a non-burning mode of operation and a burning mode of operation. In some implementations, a combustion chamber operating in the non-burning mode may receive substantially no fuel and or no spark. A combustion chamber operating in the burning mode may receive fuel to satisfy a desired air to fuel ratio, for example a constant, non-zero air to fuel ratio and/or a spark. The constant, non-zero air to fuel ratio in the burning mode may be set at 15.4:1. In some implementations, the engine may be a rotary engine.

The first and second plurality of combustion chambers may be divided into a first group or set of combustion chambers, a second set of combustion chambers, and a third set of combustion chambers. Each set of combustion chambers may include at least one combustion chamber located in the first combustion cell and at least one combustion chamber located in the second combustion cell. The combustion chambers of each group or set of combustion chambers may be oppositely disposed from the other combustion chamber (s) that make up that particular group or set of combustion chambers. For example, any given set of combustion chambers may include a combustion chamber disposed in the first combustion cell and a corresponding combustion chamber disposed in the second combustion cell, these combustion chambers being geometrically oppositely disposed such that the combustion chambers in a set of combustion chambers are symmetric. The corresponding combustion chamber in a set of combustion chambers may be in phase with the first combustion chamber in the same set of combustion chambers. For example, if the first combustion chamber in the set of combustion chambers is in the intake portion of the cycle, the corresponding chamber in the set of combustion chambers is also in the intake portion of the cycle. Combustion chambers in a set of combustion chambers maintain the same step of the internal combustion engine cycle together. More specifically the combustion chambers in a set of combustion chambers may intake air at the same time, receive fuel at the same time, receive spark ignition at the same time, and combust at the same time. The combustion chambers in a set of combustion chambers are positioned within each combustion cell in such a way each chamber of the set is opposite to the other chamber(s) in that set. For example, if one combustion chamber is at what might be thought of as the "top" of a first combustion cell, a second combustion chamber of that same set may be positioned at what might be thought of as the "bottom" of a second combustion cell. This oppositely disposed arrangement of the combustions chambers of each set of combustion chambers in the combustion cells helps to maintain the dynamic balance of the engine.

The sets of combustion chambers may switch to the burning mode of operation from the non-burning mode of operation incrementally as a power output requirement of the engine increases. More specifically, the first set of combustion chambers may operate in the burning mode while the second set of combustion chambers and the third set of combustion chambers operate in the non-burning mode when the power output requirement supplied by an electronic control unit is below a first threshold. The first set of combustion chambers and the second set of combustion chambers may operate in the burning mode while the third set of combustion chambers operates in the non-burning mode when the power output requirement supplied by the electronic control unit is above the first threshold and below a second threshold. The first set of combustion chambers, the second set of combustion chamber, and the third set of combustion chambers operate in the burning mode when the power output requirement supplied by the electronic control unit is above the second threshold.

According to another form of the present disclosure, a digital internal combustion engine may comprise an electronic control unit, a first group or set of combustion chambers, a second group of combustion chambers, and a third group of combustion chambers. Each group of combustion chambers may be configured to switch between a non-burning mode of operation and a burning mode of operation independently from the other groups of combustion chambers. The number of groups of combustion chambers that operate in the burning mode at a given time may be incrementally varied based on a power output requirement of the engine determined by the electronic control unit. The engine may be a rotary engine.

Combustion chambers operating in the non-burning mode may receive substantially no fuel and may receive no spark ignition. While the combustion chambers operating in the burning mode may operate at a constant, non-zero air to fuel ratio set by the electronic control unit. The constant, non-zero air to fuel ratio of the combustion chambers operating in the burning mode may be set at 15.4:1.

The number of groups of combustion chambers operating in the burning mode may be incrementally increased as the power output requirement of the engine increases. The number of groups of combustion chambers operating in the burning mode may be incrementally decreased as the power output requirement of the engine decreases. The number of groups of combustion chambers operating in the burning mode may be zero when the power output requirement of the engine is zero.

In some forms of the present disclosure, a digital internal combustion engine may be controlled by an electronic control unit performing the steps of receiving a user input signal, receiving a working condition signal, receiving an engine output signal, calculating an engine power output requirement based on the received signals, calculating a number of constant air to fuel ratio combustion chambers needed to satisfy the engine power output requirement, providing an engine input signal to the engine to operate in a burning mode no more than the number of constant air to fuel ratio combustion chambers needed to satisfy the engine power output requirement. Specifically, the engine input signal causes fuel to be injected into combustion chamber operating in the burning mode and causes a spark ignition to ignite the fuel present in the combustion chambers operating in the burning mode.

Additionally, the constant air to fuel ratio combustion chambers may operate at a constant air to fuel ratio of 15.4:1 when operating in the burning mode. The user input signal may be indicative of a desired vehicle speed.

The method for controlling an internal combustion engine of may further comprise selecting oppositely disposed constant air to fuel ratio combustion chambers to operate in the burning mode to maintain dynamic balance of the engine.

Additionally, the method for controlling an internal combustion engine may further comprise repeating the method steps at a set interval of time in a closed loop. As the steps of the method for controlling the internal combustion engine are repeated a further step may include increasing the number of constant air to fuel ratio combustion chambers that operate in the burning mode as the engine output requirement increases and decreasing the number of constant air to fuel ratio combustion chambers that operate in a burning mode as the engine output requirement decreases.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
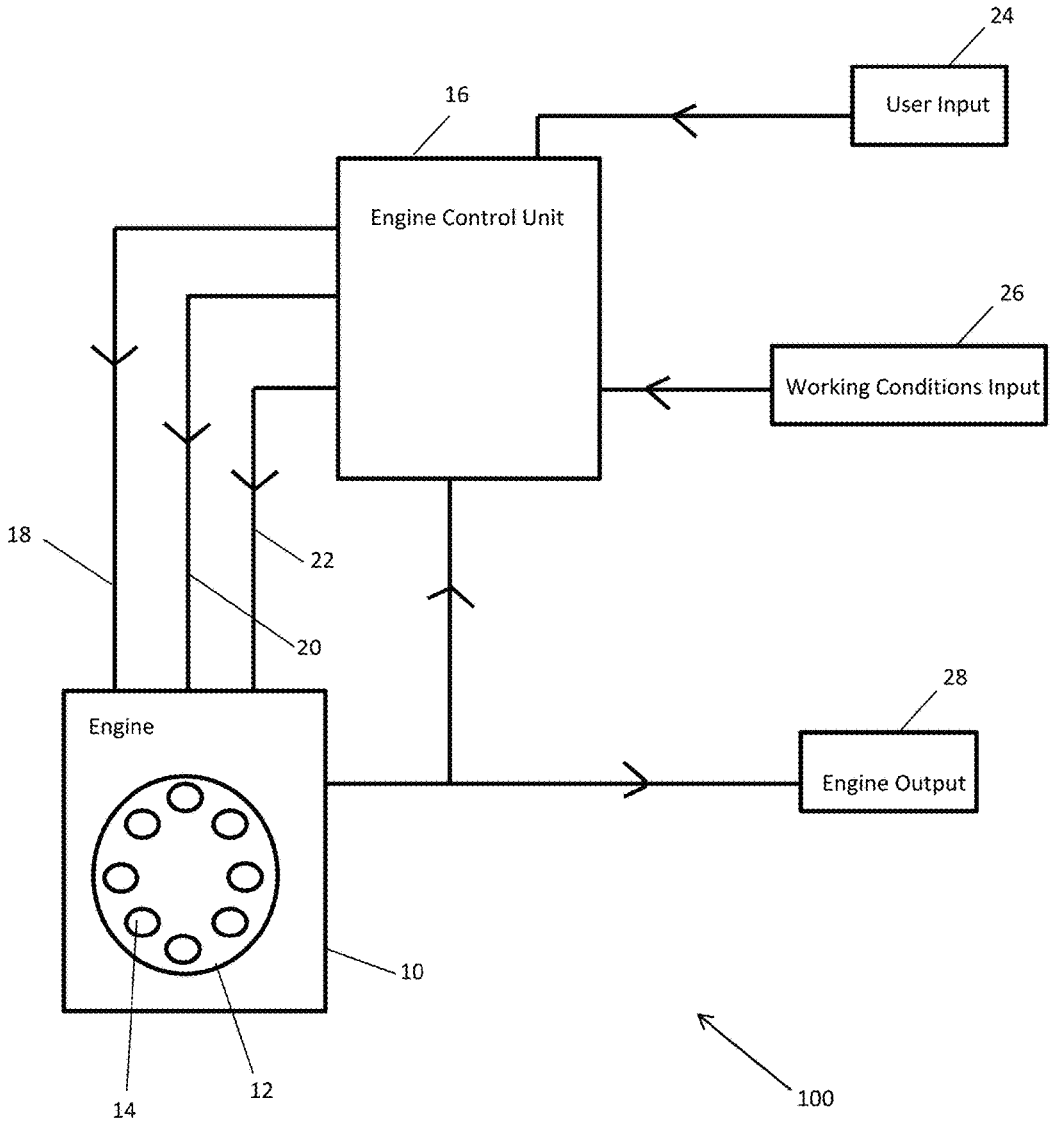
FIG. 1 is a schematic diagram illustrating a digital internal combustion engine according to one form of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

The present disclosure relates to a digital internal combustion engine and a method for controlling the same. Therefore, various forms of the digital internal combustion engine will first be described and then the method for controlling the same will be described.

Referring first to FIG. 1, a system 100 according to one form of the present disclosure generally comprises an internal combustion engine 10, an electronic control unit (ECU) 16, sensors and other means for determining or understanding working conditions 26 and a user input 24. The internal combustion engine 10 having, among other components, at least one combustion cell 12, and a plurality of combustion chambers 14. The internal combustion engine 10 may be a rotary engine. The plurality of combustion chambers 14 are disposed on and contained within the combustion cell 12. An electronic control unit 16 configured to communicate with the internal combustion engine 10 via wires or cables (not shown). The communications from the ECU 16 to the internal combustion engine 10 are controls relating to operation of the engine, including but not limited to fuel injection timing and amount 18, ignition control and timing of an element such as a spark plug 20, and intake and exhaust valve timing and position 22. The ECU 16 is also configured to receive information, including but not limited to a user input 24 and working condition input 26. The user input 24 may be a demand from a user, such as an operator of a vehicle in which the engine 10 is placed. The user input 24 may take the form of the position of a power pedal or speed pedal. Such a power or speed pedal may be thought of as being similar to a gas pedal in a traditional vehicle having a traditional internal combustion engine. A traditional gas pedal is used a way for the vehicle driver to indicate a desired vehicle speed. Depressing of a traditional "gas pedal" indicates a desired vehicle speed and causes varying amounts of fuel may be supplied to the engine to achieve the desired vehicle speed or power. In a digital internal combustion engine of the present disclosure, a traditional gas pedal is replaced with a power pedal. A vehicle driver may depress such a power pedal to indicate a desired vehicle speed, causing the number of combustion chambers operating in a burning mode to increase or decrease based on the level of pedal depression. The working condition input 26 includes, but is not limited to, information such as operating temperature, current traveling speed, current power demand, gradient, towing load, and overall weight. The ECU 16 may also receive information back from the engine 10, including but not limited to the current power output 28 of the engine 10. It will be understood by those with knowledge and skill in the relevant art that other and additional information may be communicated to and from the ECU 16, however for purposes of example only some are listed herein.

Each combustion chamber 14 is configured to switch between two modes of operation: a non-burning mode of operation and a burning mode of operation. A combustion chamber 14 operating in the non-burning mode of operation may receive no fuel into the combustion chamber and/or may not receive a spark ignition when the engine 10 is operating. Another way to think of the non-burning mode is to consider combustion chambers 14 in this condition to be "off" or "non-functional." Of course, this "off" condition may be only temporary because upon command from the ECU 16, the combustion chamber 14 may switch to the burning mode. A combustion chamber 14 operating in the burning mode of operation receives fuel into the chamber to satisfy a constant, non-zero air to fuel ratio. Another way to think of the burning mode is to consider combustion chambers 14 operating in this condition to be "on" or "functional." Like the non-burning mode, the burning mode may be only temporary for any particular combustion chamber 14.

Figure 2:
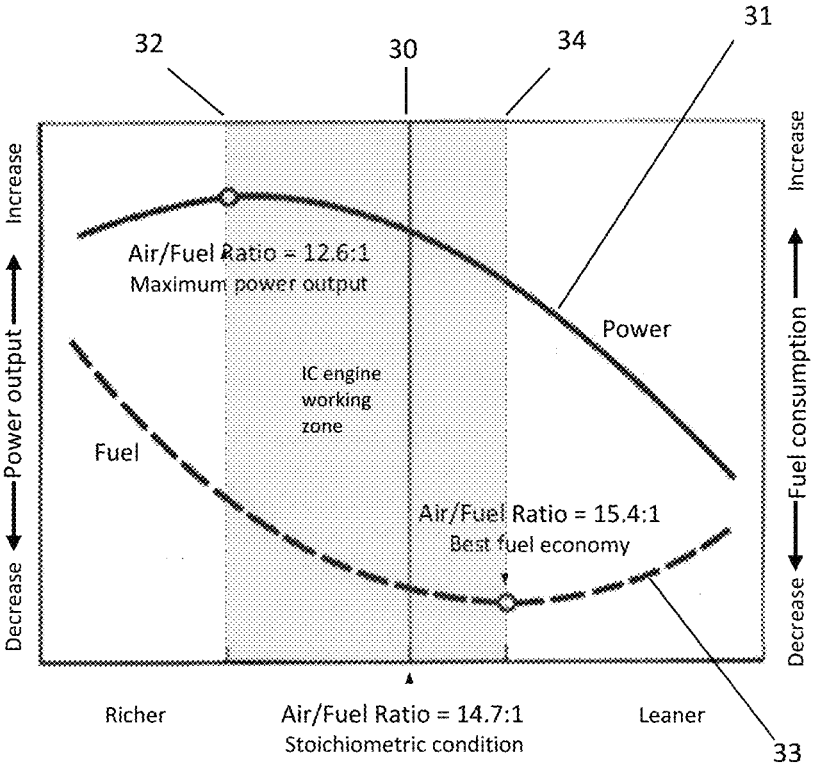
FIG. 2 is a chart depicting the air to fuel ratio working zone of a standard internal combustion engine.

An air to fuel ratio is a characteristic of an internal combustion engine that contributes to the power and fuel efficiency of the engine. The air to fuel ratio is the mass of air per a mass of fuel that is present in a combustion chamber during combustion. FIG. 2 is a graph depicting the relationship of air to fuel ratio along the x-axis to power output and fuel consumption on the y-axes. Fuel efficiency 33 and engine power 31 are charted. As shown in FIG. 2, the stoichiometric mixture or ideal air to fuel ratio 30 for gasoline is 14.7:1. At this air to fuel ratio the engine power output 31 is relatively high while the fuel consumption is relatively low, and all of the fuel is burned during combustion with no excess air being present in the combustion chamber. A maximum power output mixture 32 can be achieved with a richer air to fuel ratio of 12.6:1. Rich mixtures cause sooty combustion, poor gas mileage, misfiring and starting problems from the formation of soot in a combustion chamber and on spark plugs, overheating due to unburned gasoline collecting on an engine manifold, and emissions problems in the form of black smoke in the exhaust. The best fuel economy mixture 34 can be achieved with a leaner air to fuel ratio of 15.4:1. A problem with lean mixtures is that the power output generated is low.

Conventional internal combustion engines operate the total number of combustion chambers at a given time. In other words, the combustion chambers are either all "on" or all "off." These conventional internal combustion engines increase or decrease the power generated by the engine by varying the air to fuel ratio of the combustion chambers at a given time in response to the ECU. Most internal combustion engines continuously vary the air to fuel ratio of the combustion chambers between the maximum power output mixture 32 and the best fuel economy mixture 34, this is known as the working zone 36.

Figure 3:
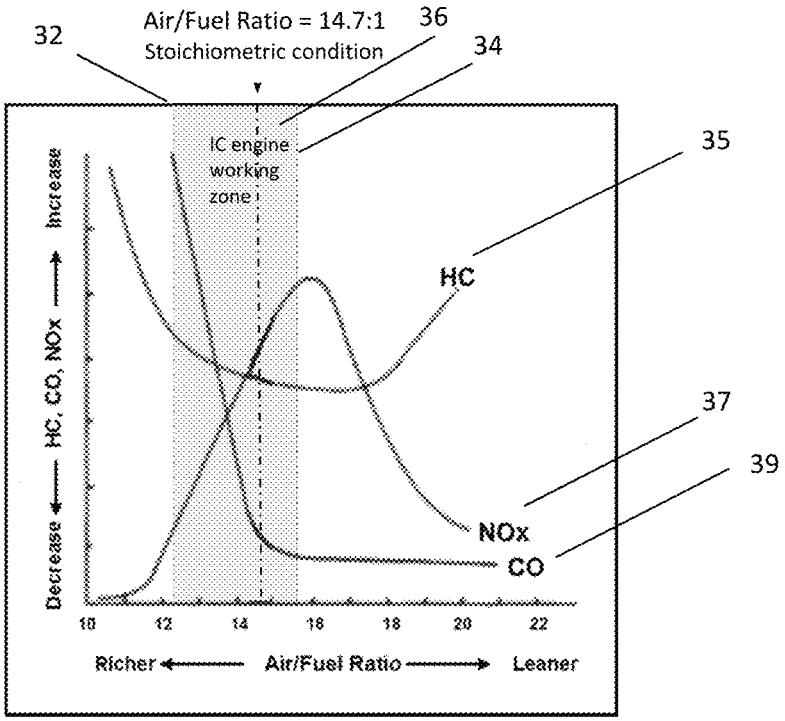
FIG. 3 is a chart depicting emission levels in the air to fuel ratio working zone of a standard internal combustion engine.

Air to fuel ratio is also related to engine emissions. FIG. 3 is a graph depicting the relationship of air to fuel ratio along the x-axis to vehicle emissions on the y-axis. As shown in FIG. 3, emissions discharged during combustion include unburned hydrocarbon (HC) 35, carbon monoxide (CO) 39, and nitrogen oxide (NOx) 37. In the air to fuel ratio working zone 36 of a standard internal combustion engine, the levels of these harmful emissions vary as the air to fuel ratio is varied from a rich mixture 32 to a lean mixture 34.

As discussed above, in some forms of the present disclosure, each combustion chamber 14 is configured to switch between two modes of operation: a non-burning mode of operation and a burning mode of operation. A combustion chamber 14 operating in the non-burning mode of operation receives no fuel into the combustion chamber and does not receive a spark ignition when engine 10 is operating. Another way to think of the non-burning mode is to consider combustion chambers 14 in this condition to be "off" or "non-functional." A combustion chamber 14 operating in the burning mode of operation receives fuel into the chamber to satisfy a constant, non-zero air to fuel ratio. Another way to think of the burning mode is to consider combustion chambers 14 operating in this condition to be "on" or "functional." The ECU 16 can control the value of the constant, non-zero air to fuel ratio of the combustion chambers 14.

Figure 4:
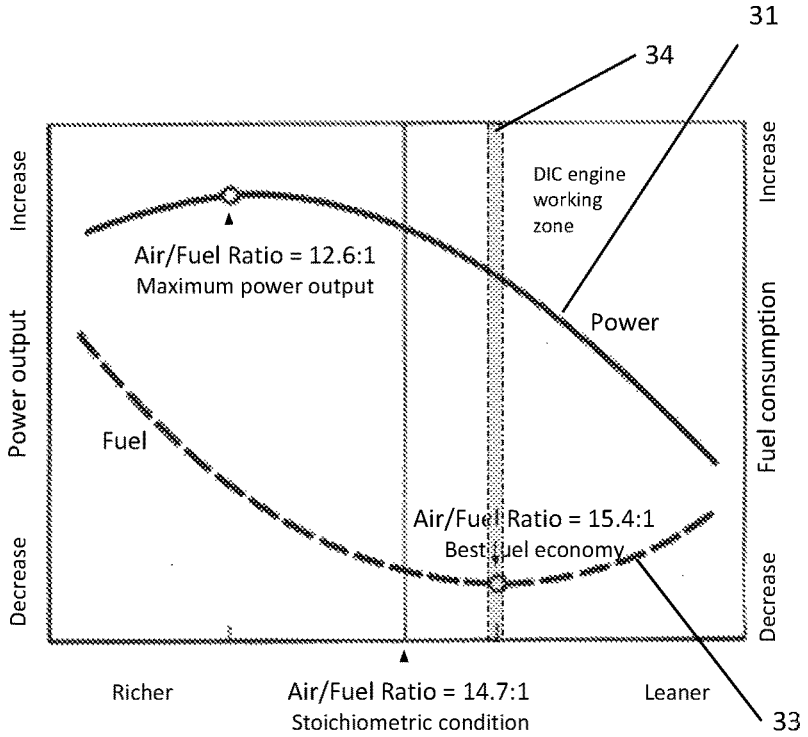
FIG. 4 is a chart depicting the air to fuel ratio working zone of a digital internal combustion engine according to one form of the present disclosure.
Figure 5:
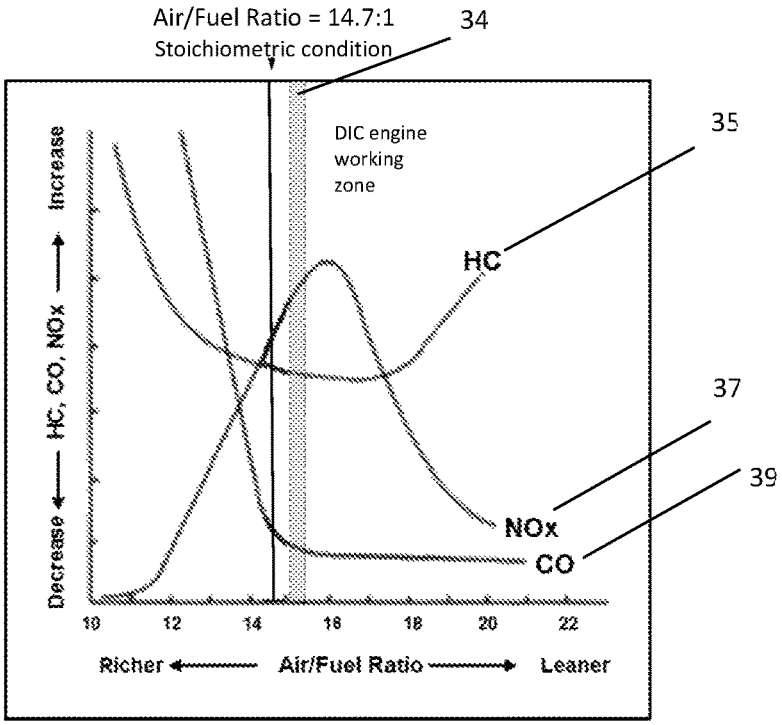
FIG. 5 is a chart depicting emission levels in the air to fuel ratio working zone of a digital internal combustion engine according to one form of the present disclosure.

According to some forms of the present disclosure, the constant, non-zero air to fuel ratio of the combustion chambers 14 operating in the burning mode is between 14.7:1 and 15.7:1, preferably between 15.3:1 and 15.5:1, and most preferably 15.4:1. It will be understood by those having ordinary skill in the art that the discussed constant, non-zero air to fuel ratio of the burning mode would be found when the engine is operating in steady state, and that when the engine experiences certain conditions such as when initially starting the vehicle or when the vehicle is operating in cold weather conditions more fuel will be provided to the combustion chambers for operation during the burning mode. FIG. 4 is a graph depicting the relationship of air to fuel ratio along the x-axis to power output and fuel consumption on the y-axes. As shown, an air to fuel ratio of 15.4:1 is the air to fuel ratio that provides the best fuel economy mixture 34. FIG. 5 is a graph depicting the relationship of air to fuel ratio along the x-axis to vehicle emissions on the y-axis. FIG. 5 shows that operating the combustion chambers 14 using the best fuel economy mixture 34 results in low levels of CO 39 and HC 35. While it has been discussed that the best fuel economy mixture 34 produces low power output, the power output 28 of the engine 10 can be increased by increasing the number of combustion chambers 14 operating in the burning mode. Unlike conventional internal combustion engines, the combustion chambers 14 of a digital internal combustion engine 10 of the present disclosure act independent of one another, for example, not all of the combustion chambers 14 must be operating in the burning mode at any given time because some chambers may be "off" if the power output requirement is low. Namely, fewer than the total number of combustion chambers 14may be in the non-burning mode while fewer than the total number of combustion chamber 14 may be in the burning mode at a given time.

Figure 6:
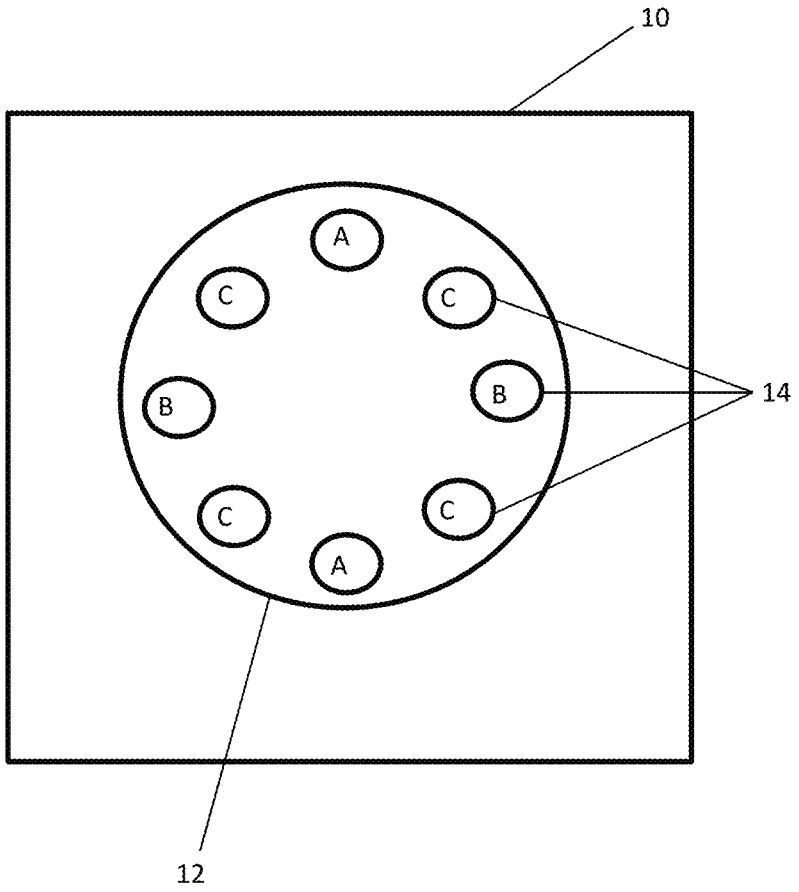
FIG. 6 is a schematic diagram illustrating combustion chambers of a digital internal combustion engine having a single cell according to one form of the present disclosure.

According to some forms of the present disclosure, the combustion chambers 14 operate in sets or groups A, B, C, as shown in FIG. 6. A single cell implementation is described with respect to FIG. 6, however, any number of cells having the same structure and same method of operation may be used in combination. As the ECU 16 receives information regarding the user input 24 and the working conditions input 26 and calculates an engine output requirement 28, the ECU may determine the number of combustion chambers 14 that must operate in the burning mode in order to satisfy the engine output requirement 28. The user input 24 may be indicative of a user's desired vehicle speed. This input 24 may be communicated to the ECU via a input device situated within the vehicle cabin near the user. The input device may take the form of a power pedal, similar in location and operation as a traditional gas pedal, that indicates the user's desired vehicle speed based on the extent to which the pedal is depressed. The ECU 16 sends this information to the engine and thereby causes the requisite number of combustion chambers 14 to switch from the non-burning mode to the burning mode. More specifically, the combustion chambers 16 operating in the burning mode may be incrementally varied in sets or groups A, B, C. As shown in FIG. 6, the sets or groups of combustion chambers may include as few as two combustion chambers 14 (group A and group B) or more than two combustion chamber 14 (group C). It will be understood that group C may be further divided to include only two combustion chambers 14 and a group D having two combustion chambers. Although, three groups are discussed in the present example, it is contemplated therein that more than three groups may be utilized.

For example, as the engine output requirement 28, such as a power output requirement, is incrementally increased a first set or group of combustion chambers A may switch from the non-burning mode to the burning mode. As the power output requirement 28 is further increased, a second set or group of combustion chambers B join the first set of combustion chambers A in operating in the burning mode. Alternatively, combustion chambers B may switch to the burning mode, while combustion chambers A switch to the non-burning mode. As the power output 28 remains constant the number of sets or groups of combustion chambers 14 operating in the burning mode remains unchanged from the last iteration. As the power output requirement 28 is further increased, a third set or group of combustion chambers C join the first and second sets or groups of combustions chambers A, B operating in the burning mode. Alternatively, combustion chambers C may switch to the burning mode, while combustion chambers A and combustion chambers B switch to the non-burning mode. The combustion chambers A, B, C, operating in the burning mode may be dependent on the power output requirement of the engine. When the total number of combustion chambers 14 are operating in the burning mode, the maximum engine power output has been achieved. When the ECU receives a signal that the user has released the power pedal or for example the load on the vehicle decreases, the power output requirement 28 of the engine 10 is decreased, the third set of combustion chambers C may switch from the burning mode to the non-burning mode, leaving just the first and second sets or groups of combustion chambers A, B operating in the burning mode, or in some implementations, combustion chamber A and combustion chambers B may be switched to the non-burning mode so just combustion chambers C are operating in the burning mode, thereby the engine power output 28 is reduced in response from the engine power output requirement as communicated to the engine 10 from the ECU 16. When the ECU 16 receives a signal that a user is braking or the vehicle does not require power to compel the vehicle along a path, for example, the vehicle is traveling down a gradient, the ECU 16 controls the engine 10 to switch combustion chambers 14 from the burning mode to the non-burning mode, thereby conserving fuel and improving fuel efficiency. In some implementations, each of the groups may have the same volume and shape of combustion chamber. In some implementations, one group may have combustions chambers with different volume and/or shape than other groups.

As seen in single cell engine configuration of FIG. 6 the sets or groups of combustion chambers A, B, C may be made up of combustion chambers 14 that are oppositely disposed from one another. Such an arrangement helps ensure the engine 10 remains in dynamic balance. The combustion chambers 14 of each group or set of combustion chambers may be oppositely disposed from the other combustion chamber(s) that make up that particular group or set of combustion chambers. The combustion chambers 14 are geometrically oppositely disposed such that the combustions chambers in a set of combustion chambers are symmetric. The corresponding combustion chamber in a set of combustion chambers may be in phase with the first combustion chamber in the same set of combustion chambers. For example, if the first combustion chamber in the set of combustion chambers is in the intake portion of the cycle, the corresponding chamber in the set of combustion chambers is also in the intake portion of the cycle. Combustion chambers 14 in a set of combustion chambers maintain the same step of the internal combustion engine cycle together. More specifically the combustion chambers in a set of combustion chambers intake air at the same time, receive fuel at the same time, receive spark ignition at the same time, and combust at the same time. The combustion chambers 14 are positioned in such a way that each chamber of the set is opposite to the other chamber(s) in that set. For example, if one combustion chamber is at what might be thought of as the "top" of a combustion cell, a second combustion chamber of that same set may be positioned at what might be thought of as the "bottom" of the combustion cell. This oppositely disposed arrangement of the combustions chambers 14 of each set of combustion chambers 14 helps to maintain the dynamic balance of the engine 10.

Figure 7:
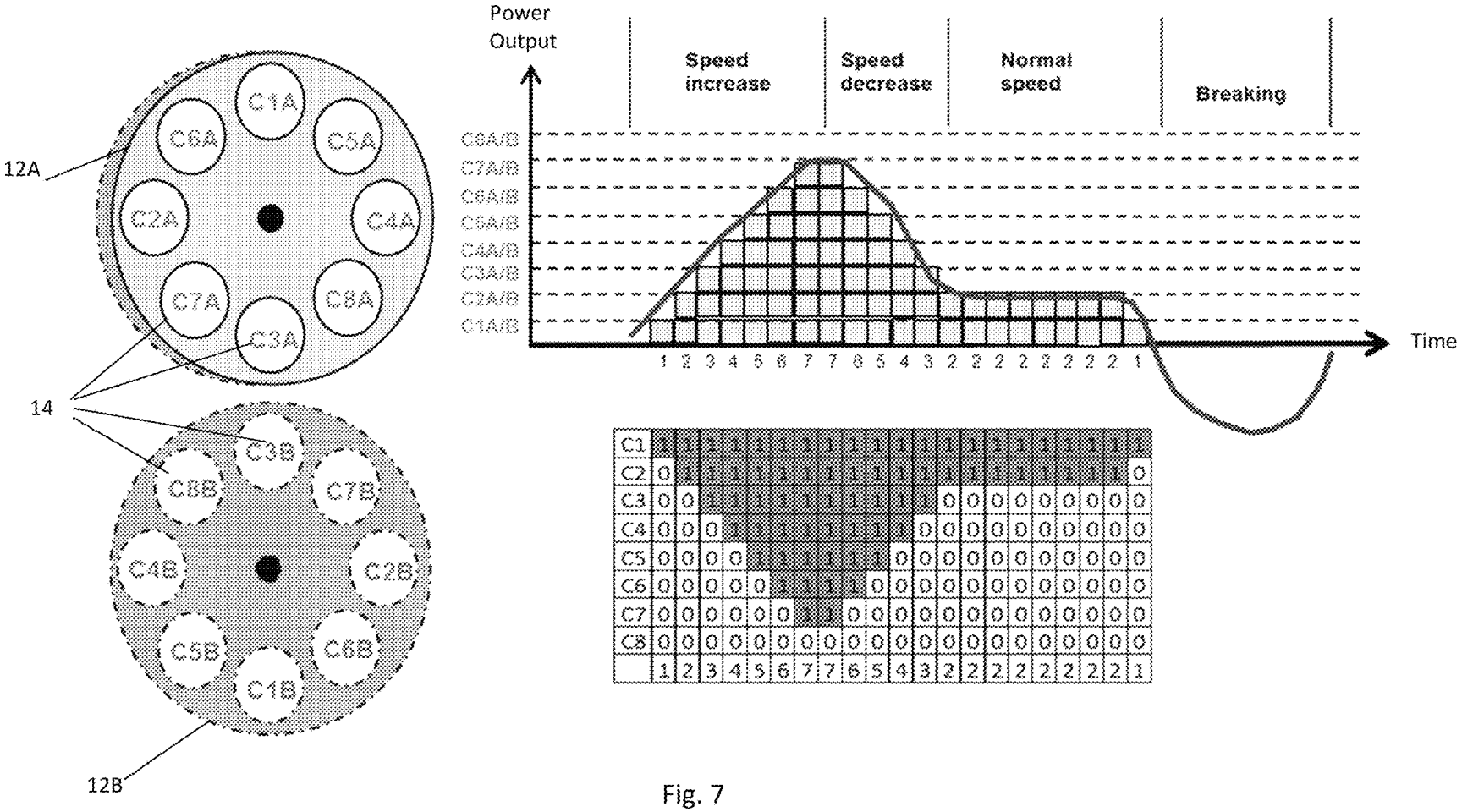
FIG. 7 is an illustration depicting how the combustion chambers work in a digital internal combustion engine having multiple cells according to one form of the present disclosure.

Alternatively, as shown in FIG. 7, a digital internal combustion engine 10 may have multiple combustion cells 12A, 12B. It will be understood that additional combustion cells 12 may be added to the engine 10 in order to provide more vehicle power capabilities and a greater level of engine adjustment. For purposes of this description, only two combustion cells 12A and 12B are discussed, the same principles would apply to additional combustion cells 12. Each combustion cell 12A, 12B may contain a plurality of combustion chambers 14. These combustion chambers 14 may be grouped into sets of combustion chambers C1, C2, C3, C4, C5, C6, C7, C8, the number of groups or sets depending on the number of combustion chambers 14 each combustion cell 12 contains. Each group or set of combustion chambers C1, C2, C3, C4, C5, C6, C7, C8 includes at least one combustion chamber 14 from the first combustion cell 12A and at least one combustion chamber 14 from the second combustion cell 12B. For example, group C1 may include chambers C1A and C1B, and group C2 may include combustion chamber C2A and C2B. The sequence in which these groups or pairs switch from the burning mode to the non-burning mode is controlled by the ECU 16 based on a power output requirement 28 of the engine 10. The power output requirement or of the engine may be in part based on a demand of a user. In addition to a user demand, the power output requirement may also be based on the load under which the vehicle is operating, road conditions, road gradient, vehicle weight, etc. The user demand may be communicated to the ECU to determine the power output requirement by means of the user depressing a gas or power pedal.

In a low power output requirement 28 condition, combustion chambers in group C1 may be switched to the burning mode from the non-burning mode, meaning the combustion chamber C1A from a first combustion cell 12A and combustion chamber C1B from a second combustion cell 12B would operate in the burning mode. As the power output requirement 28 increases, the number of combustion chambers operating in the burning mode also increases. For example, combustion chambers in group C2 may be switched to the burning mode from the non-burning mode, meaning the combustion chamber C2A from the first combustion cell 12A and combustion chamber C2B from the second combustion cell 12B would operate in the burning mode.

Current internal combustion engines may present challenges in applying digital internal combustion engine technology due to the engine dynamic balance shown in Table 1. The digital internal combustion engine application may operate more efficiently with an engine having greater level of adjustment. Traditional internal combustion engines do not have cylinders that can work individually or independently from the other combustion cylinders in the engine. These traditional internal combustion engines require at least three or four cylinders operating simultaneously to maintain engine dynamic balance. For the digital internal combustion engine, eight or more levels of combustion chamber adjustment may be preferred for some automotive applications. As such, eight or more levels of adjustment may be provided. Accordingly, the engine may have at least sixteen separate combustion chambers.

TABLE 1

| Total number of engine cylinders | May DIC be applied | Minimum number of cylinders for engine balance |
|---|---|---|
| 4 | No | 4 |
| 6 | Limited | 3 and 6 |
| 8 | Limited | 4 and 8 |

The graph portion of FIG. 7 shows how the groups or sets of combustion chambers C1, C2, C3, C4, C5, C6, C7, C8 increase and decrease over time as the power output requirement 28 of the engine 10 is increased and decreased. The number of combustion chambers operating 14 operating in the burning mode increases as there is a speed or power output requirement 28 of the engine 10 increases. The number of combustion chambers 14 operating in the burning mode decreases as the speed or power output requirement 28 of the engine 10 decreases. The number of combustion chambers 14 operating in the burning mode remains constant as the power or speed output requirement 28 of the engine 10 remains constant. The number of combustion chambers 14 operating in the burning mode drops to zero when the speed or power output requirement 28 of the engine 10 is zero, or in other words when a user is braking.

At slower speeds, when the power output requirement of the engine is low, only a small number of combustion chambers are in the burning mode of operation. At higher speeds, when the power output requirement of the engine is high, all of the combustion chambers are in the burning mode of operation.

Figure 8:
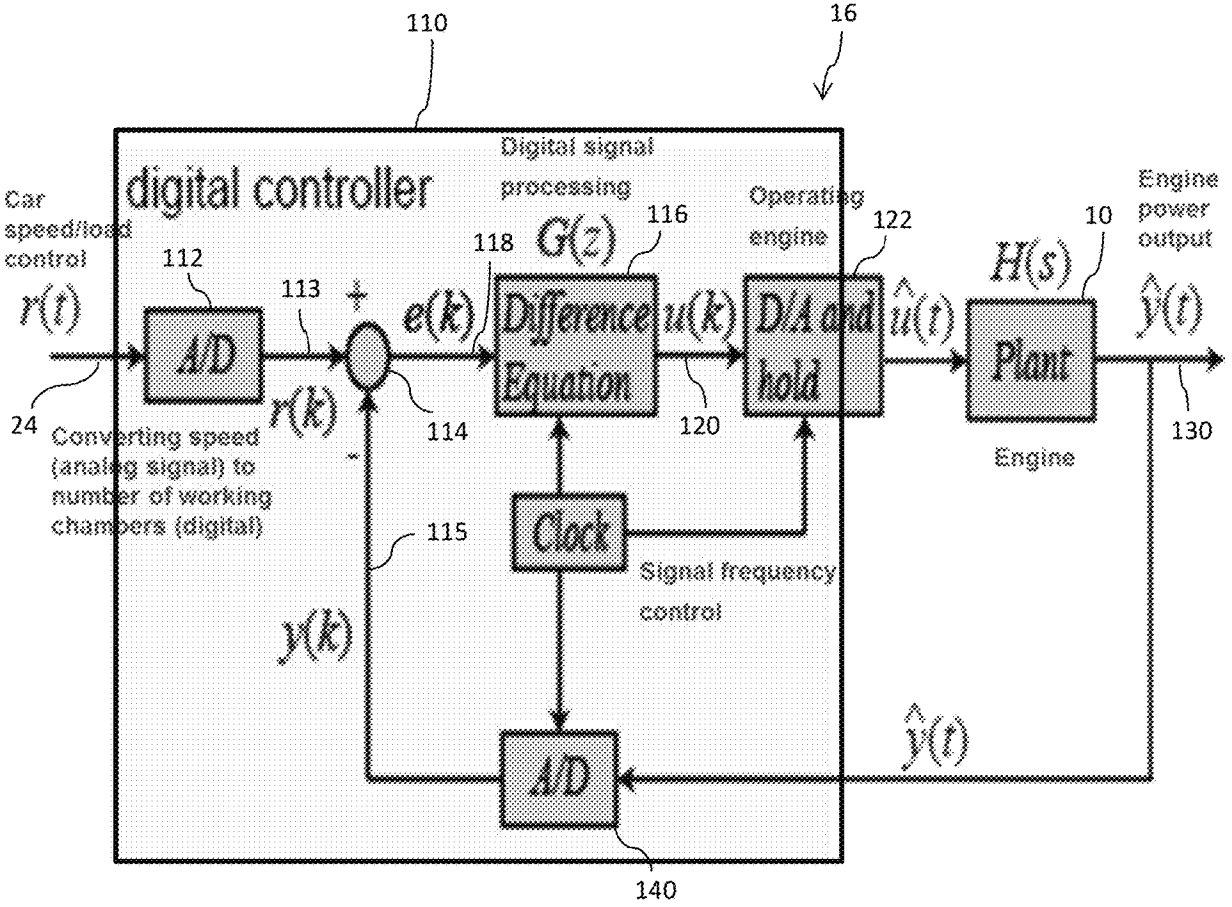
FIG. 8 is a block diagram illustrating a digital controller for a digital internal combustion engine according to one form of the present disclosure.

Another form of the present disclosure provides a method for controlling a digital internal combustion engine. FIGS. 1 and 8 show the various steps that may make up the method. First, an electronic control unit (ECU) 16 receives a user input signal 24 and a working condition signal 26. The ECU 16 may also receive an engine output signal 28. The ECU 16 then calculates an engine power output requirement based on the signals received. The ECU 16 then calculates the number of constant air to fuel ratio combustion chambers 14 that are needed to operate in a burning state in order to satisfy the engine power output requirement. The ECU 16 then provides an engine input signal 38 to the engine 10 to operate no more than the number of constant air to fuel ratio combustion chambers 14 needed to satisfy the engine output requirement.

The communications from the ECU 16 to the internal combustion engine 10 are controls relating to operation of the engine, including but not limited to fuel injection timing and amount 18, ignition control and timing of an element such as a spark plug 20, and intake and exhaust valve timing and position 22. The ECU 16 is also configured to receive information, including but not limited to a user input 24 and working condition input 26. The user input 24 may be a demand from a user, such as an operator of a vehicle in which the engine 10 is placed. The user input 24 may take the form of the position of a power pedal. The working condition input 26 includes, but is not limited to, information such as operating temperature, current traveling speed, current power demand, gradient, towing load, and overall weight. The ECU 16 may also receive information back from the engine 10, including but not limited to the current power output 28 or speed of the engine 10. It will be understood by those with knowledge and skill in the relevant art that other and additional information may be communicated to and from the ECU 16, however for purposes of example only some are listed herein.

FIG. 8 is a block diagram of a digital controller. The engine control unit 16 may include the digital controller 110. The digital controller 110 is configured to transfer sources of variations that would otherwise result in deviation from a desired dynamic response, for example a variation from a desired load or speed. The digital controller 110 receives a signal 24 indicating the desired vehicle speed or load. The analog-to-digital converter 112, A/D, converts the speed signal, which may be an analog signal, to a digital signal 113 indicating the number of working combustion chambers. The digital signal 113 may also specify the particular chambers. Summing module 114 combines the digital signal 113 with a digital feedback signal 115. The summing module 114 generates an error signal 118 based on the digital signal 113 and the digital feedback signal 115. The digital signal processing module 116 determines a digital output signal 120. The output of the digital signal processing module 116 is provided to a digital-to-analog converter 122, D/A, to control operation of the engine. The output of the D/A 122 may be provided to the engine 10. The output 130 of the engine 10, for example engine speed or power, may be monitored by an ND 140. The A/D 140 may generate the digital feedback signal 115 based on the output 130 of the engine 10, thereby completing a feedback loop to control the activation of the combustion chambers in response to the engine speed or load. Further, a clock 150 is provided to drive the analog-to-digital converters 112 and 140 which may take analog inputs and convert them to a sequence of sampled values every clock tick or T, seconds. The digital processing module 116 computes the input to the dynamic system based on the sampled values of r(t) and y(t) so as to correct for any deviations between the two. The clock may drive the ND, the digital processing module, and the D/A. At each clock tick, the sampled output may be compared to the desired output, and a corrective input is applied to the system.

The air to fuel ratio of the constant air to fuel ratio combustion chambers 14 may be 15.4:1 when the combustion chambers 14 are operating in the burning mode. As discussed above, this air to fuel ratio is the best fuel economy mixture.

The method for controlling a digital internal combustion engine may also include the step of selecting oppositely disposed constant air to fuel ratio combustion chambers 14 to operate in the burning mode to maintain dynamic balance of the engine 10. Specifically, switching groups or sets of combustion chambers 14 that are arranged opposite each other as discussed above and shown in FIGS. 6 and 7.

The method for controlling a digital internal combustion engine may also include the step of repeating the steps of the method at a set interval of time in a closed loop. Additionally, as the steps of the method are repeated in a closed loop and as the power output requirement 28 of the engine 10 increases or decreases, the ECU 16 with recalculate the number of combustion chambers 14 needed to satisfy the engine power output requirement 28 and adjust the number of combustion chambers 14 operating in the burning mode accordingly. More specifically, as the power output requirement of the engine increases, the number of combustion chambers 14 operating in the burning mode will increase and as the power output requirement of the engine decreases, the number of combustion chambers 14 operating in the burning mode will decrease.

The digital internal combustion engine of the present disclosure may be applied to Homogeneous Charge Compression Ignition (HCCI) engines. In an HCCI engine, the fuel and oxidizer are pre-mixed and combust due to an increase in density and temperature of the mixture, thereby causing the mixture to combust. Combustion in an HCCI engine takes place throughout the entire combustion cylinder. HCCI engines do not include a spark plug of fuel injector in the combustion chambers. The digital internal combustion engine and method of the present disclosure may be used in conjunction with HCCI technology because the digital internal combustion engine may precisely control the firing conditions for the HCCI combustion cylinders. Utilizing the digital internal combustion engine described in the present disclosure in an HCCI application, the digital internal combustion engine system may be made even more fuel efficient while producing even less harmful emissions, specifically nearly zero nitrogen oxides (NOx) and particulate matter (PM).

The description of the disclosure is merely exemplary in nature and, thus, variations that do not depart from the substance of the disclosure are intended to be within the scope of the disclosure. Such variations are not to be regarded as a departure from the spirit and scope of the disclosure

What is claimed is:

1. A digital internal combustion engine comprising:

a first combustion cell having a first plurality of combustion chambers;

a second combustion cell having a second plurality of combustion chambers;

each combustion chamber of the first and second plurality of combustion chambers being configured to switch between a non-burning mode of operation and a burning mode of operation;

wherein a combustion chamber operating in the burning mode receives fuel to satisfy a constant, non-zero air to fuel ratio; and a first set of combustion chambers, a second set of combustion chambers, and a third set of combustion chambers, wherein each set of combustion chambers includes at least a first combustion chamber of the first plurality of combustion chambers of the first combustion cell and at least a second combustion chamber of the second plurality of combustion chambers of the second combustion cell disposed relative to the first combustion chamber to maintain dynamic balance of the engine, the first set of combustion chambers operates in the burning mode while the second set of combustion chambers and the third set of combustion chambers operate in the non-burning mode when a power output requirement supplied by an electronic control unit is below a first threshold.

2. The digital internal combustion engine of claim 1, wherein:

the first set of combustion chambers and the second set of combustion chambers operate in the burning mode while the third set of combustion chambers operates in the non-burning mode when the power output requirement supplied by the electronic control unit is above the first threshold and below a second threshold.

3. The digital internal combustion engine of claim 2, wherein:

the first set of combustion chambers, the second set of combustion chamber, and the third set of combustion chambers operate in the burning mode when the power output requirement supplied by the electronic control unit is above the second threshold.

4. The digital internal combustion engine of claim 1, wherein:

the constant, non-zero air to fuel ratio in the burning mode is 15.4:1.

5. A digital internal combustion engine comprising:

an electronic control unit;

a first group of combustion chambers, a second group of combustion chambers, and a third group of combustion chambers;

each group of combustion chambers configured to switch between a non-burning mode of operation and a burning mode of operation independently from the other groups of combustion chambers;

wherein a number of the groups of combustion chambers that operate in the burning mode is incrementally varied based on a power output requirement of the engine determined by the electronic control unit, such that the first group of combustion chambers operates in the burning mode while the second group of combustion chambers and the third group of combustion chambers operate in the non-burning mode when a power output requirement supplied determined by the electronic control unit is below a first threshold.

6. The digital internal combustion engine of claim 5, wherein:

the combustion chambers operating in the non-burning mode receive substantially no fuel.

7. The digital internal combustion engine of claim 5, wherein:

the combustion chambers operating in the burning mode operate at a constant, non-zero air to fuel ratio set by the electronic control unit.

8. The digital internal combustion engine of claim 7, wherein:

the constant, non-zero air to fuel ratio of the combustion chambers operating in the burning mode is 15.4:1.

9. The digital internal combustion engine of claim 5, wherein:

the number of groups of combustion chambers operating in the burning mode incrementally increases as the power output requirement of the engine increases, the number of groups of combustion chambers operating in the burning mode incrementally decreases as the power output requirement of the engine decreases, and the number of groups of combustion chambers operating in the burning mode is zero when the power output requirement of the engine is zero.

* * * * *